US008695585B2

(12) United States Patent
Kessler et al.

(10) Patent No.: US 8,695,585 B2
(45) Date of Patent: Apr. 15, 2014

(54) GREASE FILTRATION SYSTEM AND METHODS OF MAKING AND USING THE SAME

(76) Inventors: Terry Kessler, Big Spring, TX (US); Keith Crane, Big Spring, TX (US)

( * ) Notice: Subject to any disclaimer, the term of this patent is extended or adjusted under 35 U.S.C. 154(b) by 2609 days.

(21) Appl. No.: 11/358,468

(22) Filed: Feb. 21, 2006

(65) Prior Publication Data

US 2007/0193574 A1 Aug. 23, 2007

(51) Int. Cl.
*F24C 15/20* (2006.01)
*B08B 15/02* (2006.01)
*B01D 29/52* (2006.01)

(52) U.S. Cl.
USPC ..... 126/299 D; 126/299 E; 126/299 F; 126/299 R; 126/300; 126/301; 454/66; 454/242; 454/253; 110/203; 110/216; 95/273; 95/284; 55/341.1

(58) Field of Classification Search
USPC ..... 126/299 D, 299 E, 299 F, 299 R, 300, 126/301; 55/341.1; 95/273, 284, 286, 287; 110/203, 216, 217; 454/66, 242, 253
See application file for complete search history.

(56) References Cited

U.S. PATENT DOCUMENTS 2,862,437 A * 12/1958 Smith et al. ..... 126/299 D
3,411,428 A * 11/1968 Ahlrich ..... 126/299 D
3,494,113 A * 2/1970 Kinney ..... 55/481
3,496,704 A * 2/1970 Bandlow ..... 96/138
3,583,306 A * 6/1971 Hagdorn ..... 126/299 D
3,695,164 A * 10/1972 Stalker ..... 126/299 D
3,796,549 A * 3/1974 Hall ..... 422/169
3,837,269 A * 9/1974 Sweet et al. ..... 126/299 E
3,952,640 A * 4/1976 Kuechler ..... 126/299 D
3,978,777 A * 9/1976 Nett ..... 126/299 D
4,084,947 A * 4/1978 Ear ..... 96/233
4,130,111 A * 12/1978 Ristic ..... 126/299 D
4,475,534 A * 10/1984 Moriarty ..... 126/299 D
4,483,316 A * 11/1984 Fritz et al. ..... 126/299 D
4,517,883 A * 5/1985 Levchenko et al. ..... 454/61
4,853,005 A * 8/1989 Jaisinghani et al. ..... 96/60
4,902,316 A * 2/1990 Giles et al. ..... 96/58
4,921,509 A * 5/1990 Maclin ..... 96/18
5,063,906 A * 11/1991 Rogers et al. ..... 126/299 D
5,069,197 A * 12/1991 Wisting ..... 126/299 E
5,154,161 A * 10/1992 Rogers et al. ..... 126/299 D
5,167,677 A * 12/1992 Hammes ..... 96/17
5,540,744 A * 7/1996 Renna ..... 55/323
5,771,879 A * 6/1998 Saltzman ..... 126/299 R
6,099,612 A * 8/2000 Bartos ..... 55/481
6,170,480 B1 * 1/2001 Melink et al. ..... 126/299 R
6,206,774 B1 * 3/2001 Dexter et al. ..... 454/5
6,293,983 B1 * 9/2001 More ..... 55/486
6,447,566 B1 * 9/2002 Rivera et al. ..... 55/482
7,037,810 B2 * 5/2006 Hayashi ..... 438/479
2003/0101986 A1 * 6/2003 Maier ..... 126/299 R
2006/0278216 A1 * 12/2006 Gagas et al. ..... 126/299 D
2008/0193326 A1 * 8/2008 Mole ..... 422/2
2008/0193328 A1 * 8/2008 Crapser et al. ..... 422/5

* cited by examiner

*Primary Examiner* — Kang Hu
*Assistant Examiner* — Daniel E Namay
(74) *Attorney, Agent, or Firm* — Withers & Keys, LLC

(57) ABSTRACT

Grease filtration systems suitable for use on the rooftop of a building are disclosed. Methods of making and using grease filtration systems are also disclosed.

2 Claims, 8 Drawing Sheets

FIG 1 GREASE FILTRATION SYSTEM
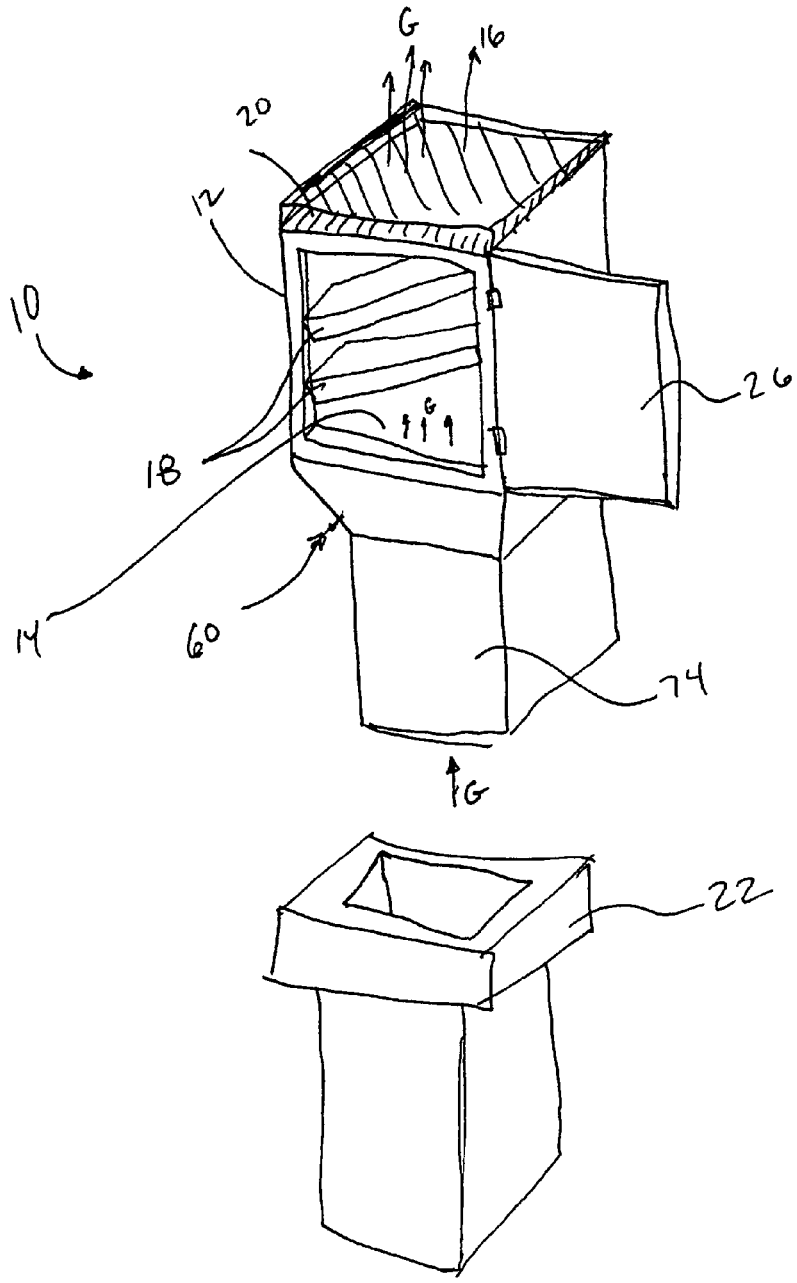

FIG. 2 HOUSING
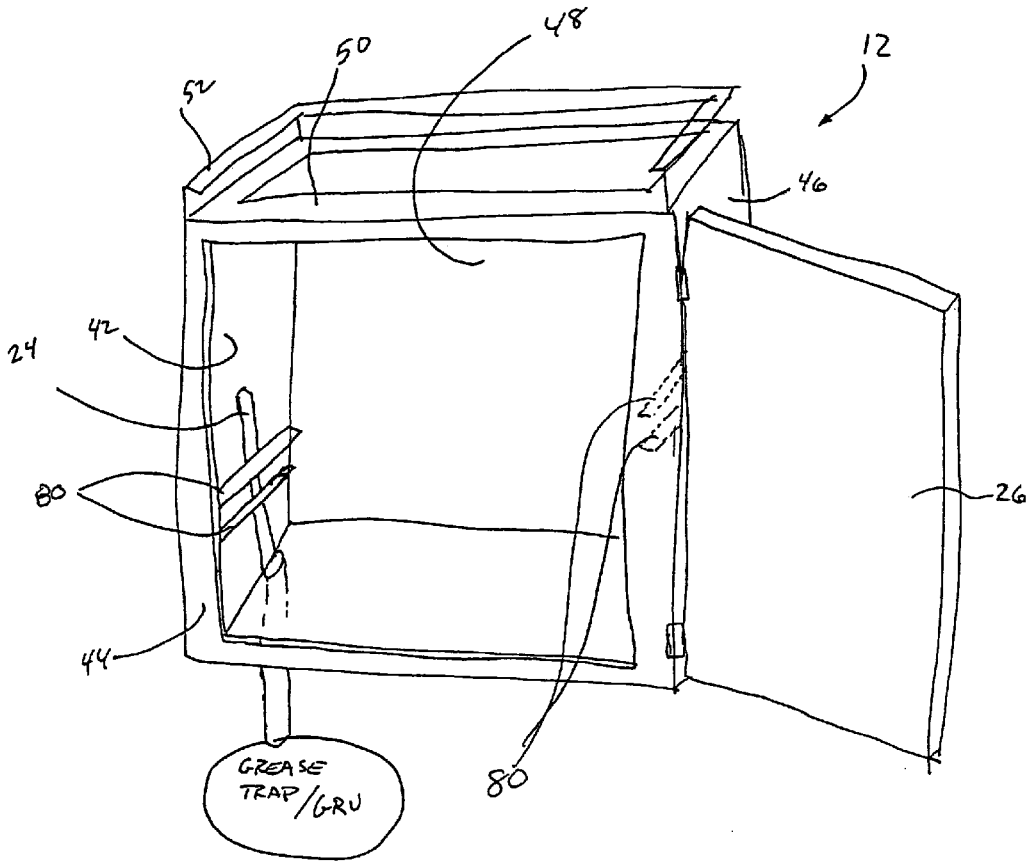

FIG. 3 DIFFUSER SECTION
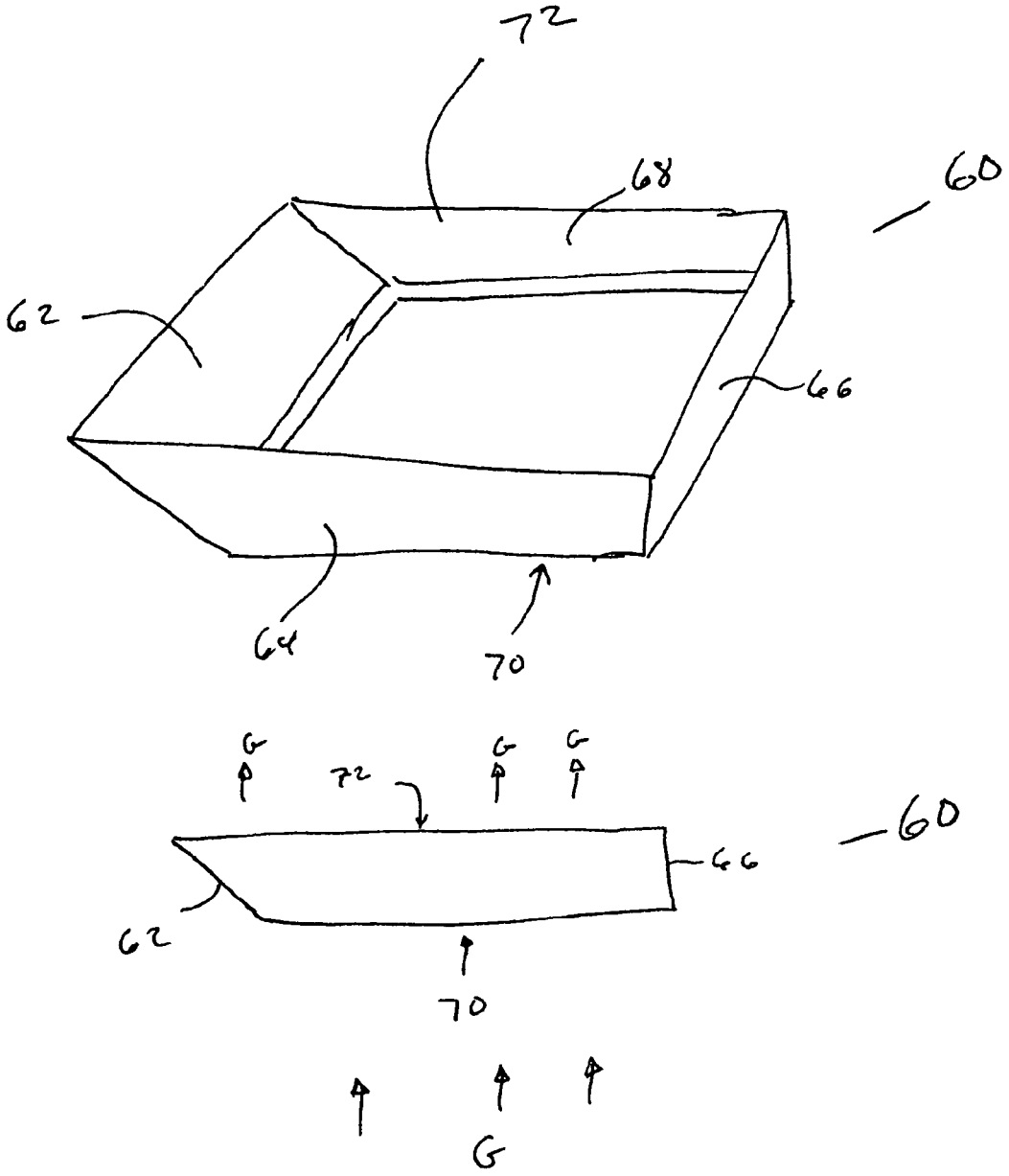

FIG. 4 FIRST FILTER
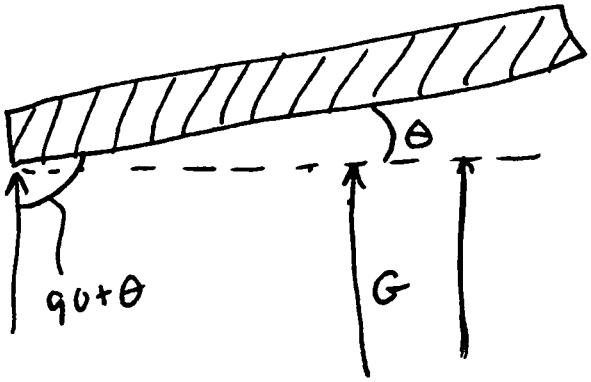

FIG. 6 SECOND FILTER
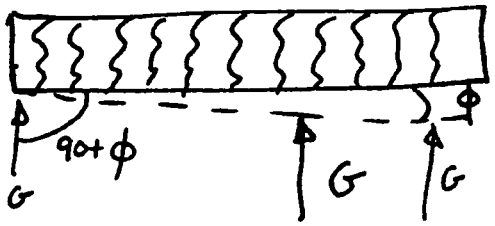

GREASE FILTRATION SYSTEM AND METHODS OF MAKING AND USING THE SAME

FIELD OF THE INVENTION

The present invention relates to grease filtration systems suitable for use on the rooftop of a building. The present invention further relates to methods of making and using grease filtration systems.

BACKGROUND OF THE INVENTION

Commercial kitchen exhaust removal systems are employed as a primary method of ventilating the workspace for chefs, foodservice personnel, and the patrons of foodservice establishments. As the grease-laden vapor is emitted from the cooking appliance line, the plume generated by the heating of the cooking rises into the kitchen exhaust system along with grease vapor, combustion by-products, and airborne contaminants.

As a fire prevention measure intended to reduce the quantity of cooking grease into the kitchen exhaust removal system, filtering of the kitchen exhaust is provided at the source of the exhaust hood, prior to the exhaust duct itself. However, traditional means of filtering the exhaust only trap a small percentage of grease and associated contaminants within the exhaust air stream. Consequently, grease-laden vapor is pulled through the primary grease removal device, and deposited on the components of the kitchen exhaust removal system including the exhaust filters, hood plenum, exhaust ductwork, and the exhaust blower.

Deposited grease within the exhaust filters, hood plenum, exhaust ductwork, and the exhaust blower must be regularly removed by a professional cleaning contractor in order to prevent fires within the kitchen exhaust removal system. Cleaning of the kitchen exhaust system normally involves cleaning of the exhaust blower, interior of the vertical and horizontal exhaust ductwork, the exhaust hood filters, plenum areas, and the exhaust hood interior itself. Such professional cleaning usually involves processes such as steam cleaning and/or pressure washing.

As cooking appliances are used on a daily basis, deposition of grease occurs greatest nearest the source of the cooking appliances, and daily reheating of the appliances will tend to re-liquefy grease residue deposited within the exhaust filter, plenum areas, and the exhaust ductwork. Natural migration of this deposited by-product induced by the exhaust blower leaves a continuous stream of grease, beginning at the grease removal device, through the interior of the exhaust ductwork, and into the exhaust blower. The interior of the exhaust blower typically experiences rapid grease soiling due to (i) fluid flow of the grease-containing air stream through the exhaust blower, (ii) paddling of the grease-containing air stream by exhaust blower blades, and (iii) the change in direction of the grease-containing air stream via the exhaust blower cowl or blower scroll housing (depending upon design), and discharge if applicable.

Between professional exhaust cleaning operations, significant volumes of grease can accumulate within the exhaust blower itself and within the exhaust ductwork. Leakage of grease from the exhaust blower housing onto the roof surface remains an ongoing challenge for many foodservice establishments. Cooking by-products damage almost all commercial roofing materials available today, and impact of the destruction of commercial roofing at foodservice establishments due to grease potentially interrupts bonds or warranties offered by the roofing installer, the contractor, and/or the construction company.

Although attempts have been made to address the problem of grease accumulation on rooftops of buildings, further efforts are needed. There exists a need in the art of effective methods and products for addressing the problem of accumulation of grease within a kitchen exhaust removal system, as well as on a building rooftop.

SUMMARY OF THE INVENTION

The present invention addresses some of the difficulties and problems discussed above by the discovery of grease filtration systems, which control and contain grease generated during normal use. The grease filtration systems of the present invention enable entrapment of grease exiting from an exhaust blower of a kitchen exhaust system.

Accordingly, in one exemplary embodiment, the present invention is directed to a grease filtration system comprising a housing, an exhaust gas inlet for supplying exhaust gas to the housing, an exhaust gas outlet for expelling exhaust gas from the housing, and at least one first filter and at least one second filter positioned within the housing such that exhaust gas passes through the at least one first filter and the at least one second filter. The exemplary grease filtration system may further comprise a number of additional components to control fluid flow of grease and grease-containing solutions. Additional components include, but are not limited to, one or more doors allowing access to the at least one first filter and the at least one second filter and one or more exhaust fans to supply grease laden air to the housing.

In a further exemplary embodiment, the grease filtration system comprises a housing, an exhaust gas inlet for supplying exhaust gas to the housing, an exhaust gas outlet for expelling gas from the housing, and at least one first filter and at least one second filter, wherein the first filter and the second filter are positioned within the housing such that exhaust gas passes through the at least one first filter and the at least one second filter, and wherein the at least one first filter and the at least one second filter are not parallel to one another.

In yet a further embodiment, the grease filtration system comprises an exhaust fan having an exhaust fan inlet for receiving exhaust gas and an exhaust fan outlet for expelling exhaust gas, and a housing having a housing exhaust gas inlet, a housing exhaust gas outlet, and at least one first filter within the housing, wherein the housing is positioned downstream of the exhaust fan.

The present invention is further directed to a method of reducing an amount of grease in a fluid, wherein the method comprises filtering the fluid through a grease filtration system, wherein the grease filtration system comprises a housing, an exhaust gas inlet for supplying exhaust gas to the housing, an exhaust gas outlet for expelling exhaust gas from the housing, and at least one first filter and at least one second filter positioned within the housing such that exhaust gas passes through the at least one first filter and the at least one second filter. The exemplary method of reducing an amount of grease in a fluid may further comprise a number of additional steps including, but not limited to, assembling one or more additional components of the grease filtration system with one another to reduce the amount of grease in a fluid.

The present invention is even further directed to a method of reducing an amount of grease on a rooftop of a building, wherein the method comprises positioning a grease filtration system downstream of an exhaust fan of a rooftop kitchen exhaust system, wherein the grease filtration system comprises a housing, an exhaust gas inlet for supplying exhaust gas to the housing, an exhaust gas outlet for expelling exhaust gas from the housing, and at least one first filter positioned within the housing such that exhaust gas passes through the at least one first filter. The exemplary method of reducing an amount of grease on a rooftop of a building may further comprise a number of additional steps including, but not limited to, assembling one or more additional components of the grease filtration system (e.g., adding at least one second filter to the housing) with one another to reduce the amount of grease on a rooftop.

These and other features and advantages of the present invention will become apparent after a review of the following detailed description of the disclosed embodiments and the appended claims.

BRIEF DESCRIPTION OF THE FIGURES

FIG. 1 depicts a view of an exemplary grease filtration system of the present invention;

FIG. 2 depicts a perspective view of the exemplary housing within the exemplary grease filtration system of FIG. 1;

FIG. 3 depicts a perspective view of the exemplary diffuser section within the exemplary grease filtration system of FIG. 1;

FIG. 4 depicts a cross-sectional view of an exemplary first filter suitable for use in the exemplary grease filtration system of FIG. 1;

FIG. 6 depicts a cross-sectional view of an exemplary second filter suitable for use in the exemplary grease filtration system of FIG. 1.

DETAILED DESCRIPTION OF THE INVENTION

Figure 5A:
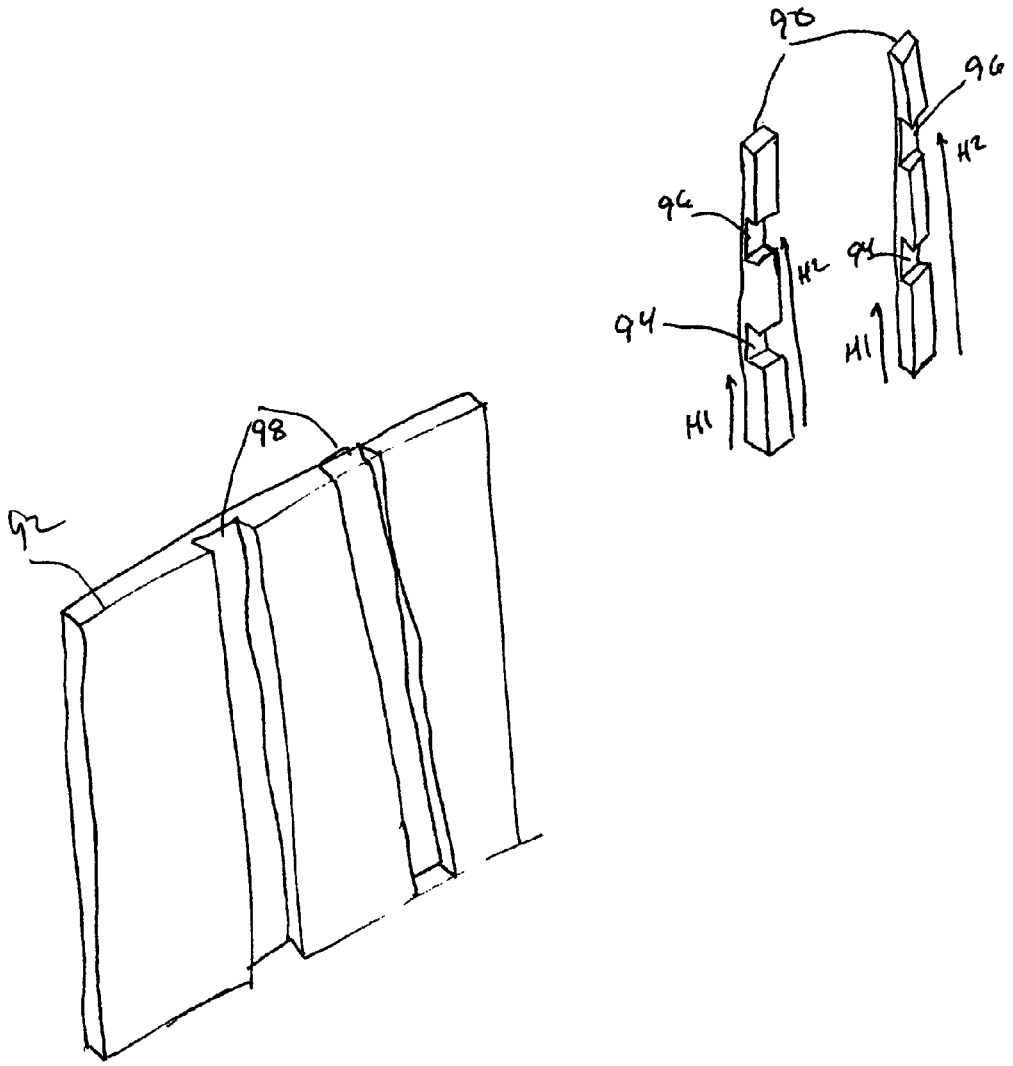
FIG. 5A depicts a view of exemplary housing features suitable for fixing a filter in a desired position within the housing.

To promote an understanding of the principles of the present invention, descriptions of specific embodiments of the invention follow and specific language is used to describe the specific embodiments. It will nevertheless be understood that no limitation of the scope of the invention is intended by the use of specific language. Alterations, further modifications, and such further applications of the principles of the present invention discussed are contemplated as would normally occur to one ordinarily skilled in the art to which the invention pertains.

The present invention is directed to grease filtration systems and methods of making and using grease filtration systems, especially for rooftop applications. The disclosed grease filtration systems may be used to control and contain grease in a variety of kitchen exhaust systems, especially commercial kitchen exhaust systems. The disclosed grease filtration systems may be designed to be used with newly constructed kitchen exhaust systems or retrofitted for existing kitchen exhaust systems.

The grease filtration systems of the present invention comprise one or more components. One exemplary grease filtration system 10 of the present invention is shown in FIG. 1. Exemplary grease filtration system 10 comprises housing 12, exhaust gas inlet 14 for supplying exhaust gas to housing 12, exhaust gas outlet 16, first filters 18, and second filter 20. As shown in FIG. 1, a grease-containing fluid, G, flows through housing 12, as well as first filters 18 and second filter 20 positioned within housing 12.

In this exemplary embodiment, exhaust gas inlet 14 is positioned downstream from one or more exhaust fans 22 (note that exhaust fan 22 is shown at a distance from duct 74 though in an actual installation these components would be in direct contact with one another). Grease that collects in housing 12 may flow by gravity down the sides of housing 12, either back through ductwork to exhaust fan 22 or to an optional grease drain 24 (shown in FIG. 2), which is desirably situated in a low fluid flow area such that the grease is more able to flow. It is preferred that optional grease drain 24 leads to a grease collection system, such as a grease trap (not shown), located below the rooftop surface. The remote grease trap or grease removal unit may be located in the kitchen, on a floor of a building below the roof, in a basement of a building, at a location outside but near a building, or any other remote location. Exemplary grease filtration system 10 may further comprise a number of optional components including, but not limited to, a diffuser section 60, one or more doors 26, and one or more housing features suitable for fixing first filters 18 and/or second filter 20 in a desired position within housing 12.

As shown by exemplary grease filtration system 10 in FIG. 1, the grease filtration systems of the present invention may comprise a number of components. A description of individual components and methods of using individual components alone or in combination with one another is provided below.

I. Grease Filtration System Components

The grease filtration systems of the present invention may comprise, but are not limited to, one or more of the following components.

A. Housing

The grease filtration systems of the present invention comprise at least one housing, such as exemplary housing 12 shown in FIGS. 1-2. Housing 12 is used to control the flow of grease-containing gases and/or grease-containing solutions downstream of a grease contaminated area, such as downstream of a rooftop exhaust fan of a kitchen exhaust system. As shown in FIGS. 1-2, exemplary housing 12 used in the present invention typically possesses a number of features, which enable efficient fluid flow control of grease and grease-containing solutions.

As shown in FIG. 2, exemplary housing 12 comprises first side wall 42, second side wall 44 (containing door 26), third side wall 46 (opposite first side wall 42), fourth side wall 48 (opposite second side wall 44), and an upper rim 50 that extends along an upper periphery of housing 12. Upper rim 50 extends outward from one or more side walls 42, 44, 46, and 48 of housing 12. As shown in FIG. 2, exemplary housing 12 comprises four side walls 42, 44, 46, 48; however, it should be understood that exemplary housing 12 may comprise any number of side walls depending on the shape of exemplary housing 12. For example, a circular housing may comprise a single side wall, while an octagonal shaped housing may comprise eight side walls. Further, top bracket 52 of housing 12 may hold one or more second filters 20 as further described below. While top bracket 52 is shown as a component of housing 12, it could be a separate component. Further, although not shown, second filters 20 could be positioned in other locations within housing 12.

The housing of the grease filtration systems of the present invention are typically made from materials that (i) resist damage from water, weather, and grease, and (ii) have a material thickness that provides desired load-bearing strength. Suitable materials for forming housings of the present invention include, but are not limited to, metals such as 16 gauge black cold roll metal, stainless steel, and fiber-reinforced composite materials. The thickness of a given material may vary depending on the material used; however, the materials typically have a wall thickness ranging from about 48 mil (0.048 in.) to about 53 mil. Desirably, the housing is formed from 16 gauge black cold roll metal having a thickness ranging from about 48 mil to about 53 mil.

Housings of the present invention may be formed using conventional methods. Suitable methods include, but are not limited to, stamping processes, rolling processes, and molding processes. Housings may be custom built for a given application and a given grease filtration system.

To increase the load-bearing capacity of the housing, additional support may be used in combination with the housing. For example, bracing beneath the housing may be used to provide additional support to the housing.

B. Diffuser Section

As shown in FIG. 1, exemplary housing 12 may be attached to a diffuser section 60 as shown in more detail in FIG. 3. In this exemplary embodiment, exemplary diffuser section 60 comprises diffuser side walls 62, 64, 66, and 68, a first diffuser opening 70 which is situated downstream from exhaust fan 22, though it may be situated any suitable distance from the exhaust fan by way of duct 74 (as shown in FIG. 1). A diffuser ratio may be defined by comparing first diffuser opening 70 with second diffuser opening 72, farther downstream from exhaust fan 22. Though any suitable ratio may be utilized depending on the specifics of an installation, it is preferred that a diffusion ratio of approximately 2.5 be utilized in order to allow the fluid flow, G, through housing 12 to be slowed in order to provide for more thorough removal of grease from the fluid and/or depending on the flow characteristics with which first filter 18 and second filter 20 have been selected. First diffuser opening 70 is preferably sized such that a duct extending from a grease-generating source can extend through first diffuser opening 70 (see, for example, exemplary duct 74 in FIG. 1 extending upward toward exemplary housing 12).

In one exemplary embodiment of the present invention, first diffuser opening 70 has an opening size and shape such that edges of first diffuser opening 70 are substantially next to outer edges of a duct 74 extending through first diffuser opening 70 (e.g., the duct has a rectangular outer perimeter having a side wall length of about 50 cm., and first diffuser opening 70 has a respective side wall length of about 50 cm. or slightly greater than 50 cm.).

First diffuser opening 70 may have any desired shape including, but not limited to, a circular, rectangular, or square shape to accommodate a duct penetrating the rooftop. Further, second diffuser opening 72 may have any desired shape including, but not limited to, a circular, rectangular, or square shape to accommodate a respective opening in housing 12.

Like the housing described above, diffuser sections suitable for use in the grease filtration systems of the present invention are typically made from materials that (i) resist damage from water, weather, and grease, and (ii) have a material thickness that provides desired load-bearing strength. Suitable materials for diffuser sections of the present invention include, but are not limited to, metals such as 16 gauge black cold roll metal, stainless steel, and fiber-reinforced composite materials.

C. First Filter

The grease filtration system of the present invention further comprises one or more first filters 18, such as exemplary first filters 18 of exemplary grease filtration system 10 shown in FIG. 1. Exemplary first filter 18 may be positioned between two sets of brackets 80 as shown in FIG. 2, with one pair on either side of housing 12 (e.g., along opposite side walls 42 and 46), or otherwise spatially fixed within housing 12. One or more first filters 18 preferably extend across housing 12 (see, FIG. 1). FIG. 4 illustrates a preferred orientation of first filter 18 relative to the exhaust gas stream G.

Exemplary first filters 18 has a rectangular configuration; however, first filters 18 (and second filters 20) of the present invention may have any desired configuration including, but not limited to, a circular configuration, a square configuration, an oblong configuration, or an octagonal configuration, though it is preferred that the first filters 18 (and second filters 20) extend across at least a majority of the housing width so as to force most, or all, of exhaust gas G to pass through the filter media.

First filters 18 may be constructed of any appropriate filter media. First filters 18 typically comprise metal filtration media such as stainless steel grease filters. Such metal filtration media are commercially available from a number of sources including, but not limited to, metal filtration media commercially available from Kason Corporation (Dallas, Tex.) such as stainless steel grease filters sold under the trade designation GREASE FILTER™ and TRAPPER™. One desired first filter 18 comprises a stainless steel grease filter such as those described above from Kason Corporation.

As illustrated in FIGS. 1 and 4, it is preferred that first filter 18, be installed at an angle Θ with respect to a normal incidence of the incoming exhaust gas (illustrated by arrows G in FIGS. 1 and 4). One benefit of such an orientation of first filter 18 by angle Θ is to both adjust the fluid flow, and also to aid in the flow of accumulated grease down the filter toward the perimeter of housing 12. It is further preferred that first filter 18 be removable and either cleanable or replaceable to maintain a high level of efficiency for the grease filtration system. As noted previously, any appropriate number of first filters 18 may be included in grease filtration system 10, such as the two shown in FIG. 1. Further, in certain installations, it may be desirable for the filtration media of first filters 18 to comprise different materials (e.g., a stainless steel filter in combination with a separate aluminum filter), and/or have different porosities to achieve higher filtration levels, and/or to decrease the amount of maintenance needed for the grease filtration system.

Figure 5B:
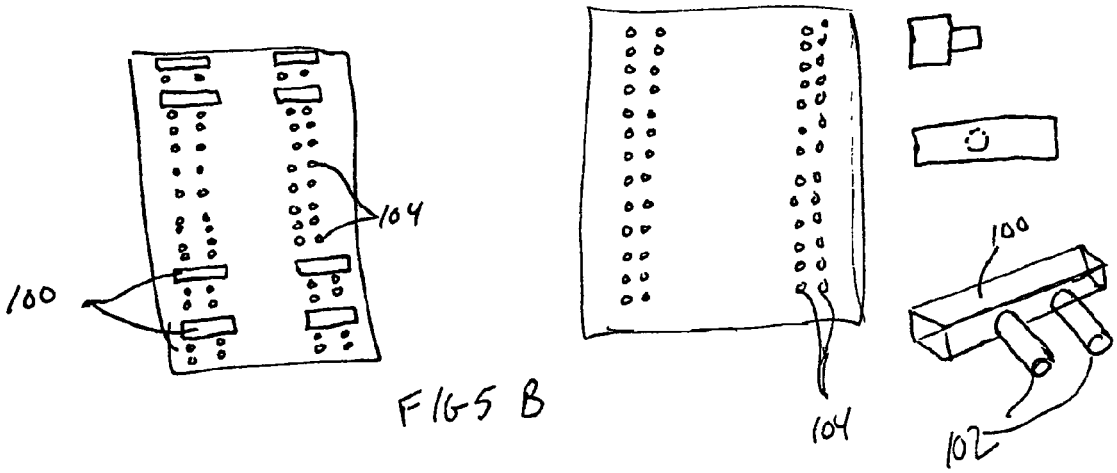
FIG. 5B depicts a view of exemplary housing features suitable for fixing a filter in a desired position within the housing.

It is further advantageous for first filter 18 to be adjustable (i.e., angle Θ can be adjusted) during installation with minimal effort. Though any suitable adjustment features may be utilized, exemplary adjustment features are illustrated in FIGS. 5A and 5B. FIG. 5A illustrates a pair of bars 90, which may contain one or more sets of cutouts 94, 96, with cutouts 94, 96 being sized to hold one or more first filters 18. One potential advantage of utilizing bars 90 is that multiple configurations and orientations of first filters 18 can be accommodated in a "standard" sized housing merely by switching bars 90 based on the specific filtration requirements of the installation. Thus, by inserting a bar, the number of first filters can be chosen as well as the orientation of the filters. It is preferred that bars 90 be constructed and spaced such that they are securely situated in housing 12 without need of other bracing. In some installations, however, it may be desirable to insert a plate 92 with slots 98 to accommodate bars 90 in order to more firmly hold bars 90, and in turn first filters 18 in place. Plate 92 can either be an individual component or part of housing 12 (e.g., forming side wall 42). It is preferred that a corresponding number of bars 90 be situated on opposite side walls of housing 12 to firmly hold first filters 18 in place. The height of first slot H1 and second slot H2 may be varied from one side of housing 12 to the other in order to tailor angle Θ of first filter 18 during installation as desired. As noted, the number and spacing of cutouts 94, 96 can be varied.

FIG. 5B illustrates a second exemplary adjustment feature for adjusting angle Θ of first filter 18. In this exemplary embodiment, pegs 100 with peg ends 102 are mated with corresponding holes 104 in a side wall of housing 12, or in a peg-plate inserted into housing 12. Thus, an installer can tailor the installation of first filters 18 by adjusting pegs 100. Pegs 100 should be sized appropriately so as to securely hold first filters 18 in a desired position.

Like housing 12 described above, the components illustrated in FIGS. 5A and 5B suitable for use in the grease filtration systems of the present invention are typically made from materials that (i) resist damage from water, weather, and grease, and (ii) have a material thickness that provides desired load-bearing strength. Suitable materials for forming bars 90, plate 92 and pegs 100 include, but are not limited to, metals such as stainless steel, and fiber-reinforced composite materials.

D. Second Filter

The exemplary grease filtration system of the present invention may further comprise one or more second filters 20, such as exemplary second filter 20 of exemplary grease filtration system 10 shown in FIG. 1. As shown in FIG. 1, exemplary second filter 20 may be positioned within a top bracket 52 at or near the top of housing 12. Second filter 20, when present, preferably extends across housing 12 (see, FIG. 1). FIG. 6 illustrates a preferred configuration of second filter 20 relative to exhaust gas stream G.

Exemplary second filter 20 has a rectangular configuration; however, as discussed above, second filter 20 may have any desired configuration including, but not limited to, a circular configuration, a square configuration, an oblong configuration, or an octagonal configuration. Second filter 20 desirably extends across at least a majority of the housing width, and more desirably, substantially the complete housing cross-sectional area, so as to force most of the exhaust gas to pass through second filter 20. Further, though shown in an exemplary position in top bracket 52, second filter 20 may be positioned at other locations within housing 12, or even spaced at some distance from housing 12 by way of additional ducting.

Second filter 20 may be constructed of any appropriate filter media. Second filter 20 typically comprises a nonwoven, non-metallic fibrous structure. Such nonwoven filtration media are commercially available from a number of sources including, but not limited to, nonwoven filtration media commercially available under the trade designation PERMAIRE™ from Republic Manufacturing (Florence S.C.), and commonly referred to as "hoghair filters." One desired second filter 20 comprises a filter comprising a blend of polyester fibers and a vinyl acetate binder material.

As illustrated in FIGS. 1 and 6, it is preferred that second filter 20 be installed at an angle Φ of approximately 0 (zero) degrees with respect to a normal incidence of incoming exhaust gas stream G (illustrated in FIGS. 1, 4 and 6), although angle Φ may vary depending on the needs of a specific installation. It is further preferred that second filter 20 be removable, cleanable and/or replaceable to maintain a high level of filtration efficiency within a given grease filtration system. As noted previously, any appropriate number of second filters 20 may be included in grease filtration system 10, such as the one shown in FIG. 1. Further, in certain installations, it may be desirable for the filtration media of one or more second filters 20 to comprise different materials (e.g., a polypropylene nonwoven filter in combination with a separate polyester nonwoven filter) and/or have different porosities to achieve higher filtration levels and/or to decrease the amount of maintenance necessary for the grease filtration system.

II. Horizontal Installation of Grease Filtration System

Figure 7:
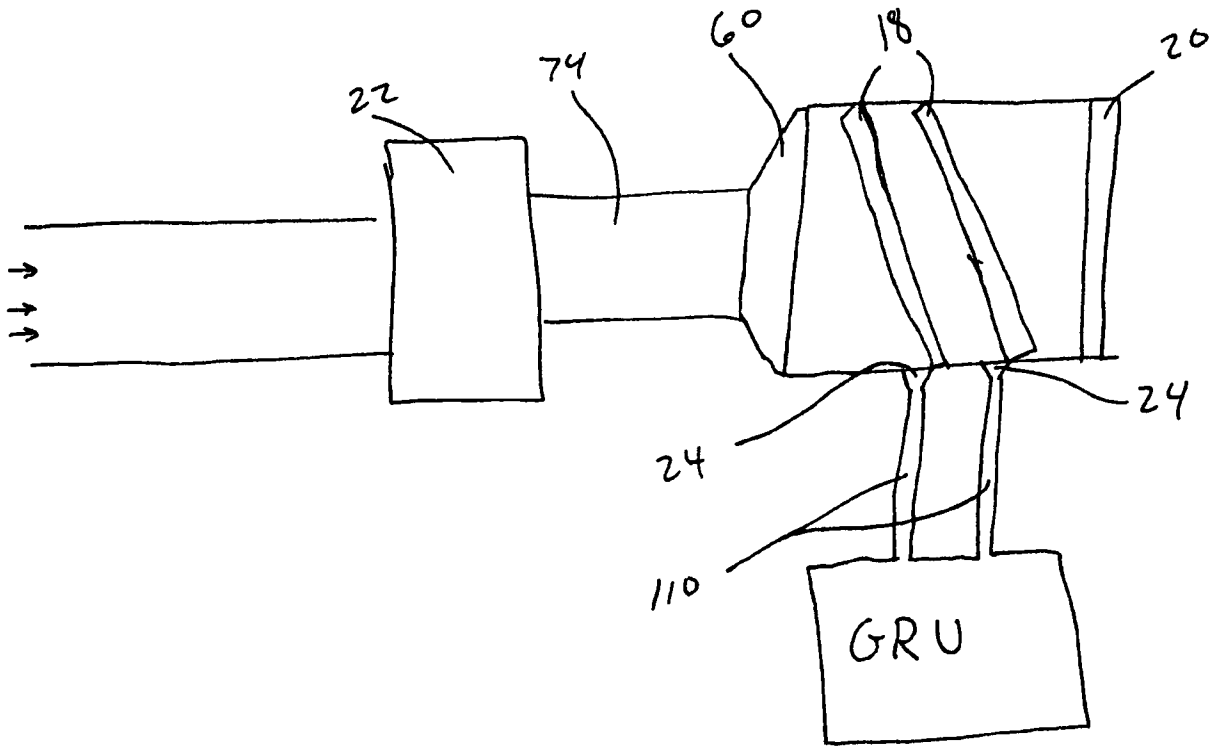
FIG. 7 depicts a cross-sectional side view of an exemplary rooftop grease filtration system of the present invention suitable for use with a side-blast exhaust fan.

FIG. 1 illustrates an exemplary grease filtration system 10 of the present invention, wherein grease filtration system 10 is positioned in a vertical position relative to exhaust fan 22. FIG. 7 illustrates a cross-sectional view of an alternate embodiment, wherein grease filtration system 100 is in a horizontal position relative to exhaust fan 22. In this embodiment, one or more optional grease drains 24 may lead to drain piping, such as exemplary drain piping 110 shown in FIG. 7. It is preferred that drain piping 110 be situated such that grease from housing 12 flows through drain piping 110 from one or more grease drains 24 in housing 12 to one or more grease collection devices 120, such as a grease trap, a grease interceptor, or a grease removal unit (GRU). Grease collection device 120 may be positioned directly below a roof structure, or may be positioned in a remote location one or more building floors away from housing 12. The number of drain openings and/or grease collection devices utilized in a given grease filtration system will depend on a number of factors including, but not limited to, the desired capacity of the grease filtration system.

III. Methods of Reducing Grease in a Fluid

The present invention is further directed to methods of reducing an amount of grease in a fluid. In one exemplary method of reducing an amount of grease in a fluid, the method comprises filtering the fluid through a grease filtration system, wherein the grease filtration system comprises a housing, an exhaust gas inlet for supplying exhaust gas to the housing, an exhaust gas outlet for expelling exhaust gas from the housing, and at least one first filter and at least one second filter positioned within the housing such that exhaust gas passes through the at least one first filter and the at least one second filter. The method of reducing an amount of grease in a fluid may further comprise a number of additional steps including, but not limited to, assembling one or more additional components of the grease filtration system (e.g., exhaust fan 22 and/or one or more grease collection devices 120) with one another to reduce the amount of grease in a fluid.

IV. Methods of Reducing Grease on the Roof of a Building

The present invention is further directed to methods of reducing an amount of grease on a rooftop. In one exemplary method of reducing an amount of grease on a rooftop of a building, the method comprises positioning a grease filtration system downstream from an exhaust fan of a rooftop kitchen exhaust system, wherein the grease filtration system comprises a housing, an exhaust gas inlet for supplying exhaust gas to the housing, an exhaust gas outlet for expelling exhaust gas from the housing and at least one first filter positioned within the housing such that exhaust gas passes through the at least one first filter. The method of reducing an amount of grease on a rooftop of a building may further comprise a number of additional steps including, but not limited to, assembling one or more additional components of the grease filtration system (e.g., one or more second filters 20) with one another to reduce the amount of grease on a rooftop.

The present invention provides a number of advantages over known grease filtration systems including, but not limited to, improved control over grease exiting from a kitchen exhaust system and a desired system capacity for containing and controlling grease.

The present invention also provides one or more of the following advantages:

1) the ability to eliminate the release of fats, oils, grease and cleaning chemicals into the environment and prevent such materials from entering water resources such as lakes, streams, and ponds;

2) the ability to minimize and/or eliminate grease on a roof surface, and providing a permanent separation of grease from a surrounding roofing material;

3) the ability to prevent roofing material failure due to grease contamination;

4) the ability to adequately address the service needs of a kitchen exhaust system, namely, the routine maintenance and cleaning of the kitchen exhaust system without having to simultaneously or subsequently clean the roof; and 5) the ability to minimize fire damage to the roof structure during a kitchen exhaust system fire.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A grease filtration system comprising:

a housing, an exhaust gas inlet for supplying exhaust gas to said housing, an exhaust gas outlet for expelling gas from said housing, at least one side wall extending between said exhaust gas inlet and said exhaust gas outlet, at least one first filter comprising a first filter inlet outermost surface and a first filter outlet outermost surface, said first filter inlet and outlet outermost surfaces being substantially within parallel first planes, at least one second filter comprising a second filter inlet outermost surface and a second filter outlet outermost surface, said second filter inlet and outlet outermost surfaces being substantially within parallel second planes, and an exhaust fan having an exhaust fan inlet for receiving exhaust gas, and an exhaust fan outlet for expelling exhaust gas, wherein said first filter and said second filter are positioned along said housing such that exhaust gas passes through said at least one first filter and said at least one second filter, wherein said parallel first planes and said parallel second planes are not parallel to one another, and wherein said housing is positioned downstream of said exhaust fan.

2. A method of reducing an amount of grease on a rooftop of a building, wherein the method comprises:

positioning a grease filtration system downstream of an exhaust fan of a rooftop kitchen exhaust system, wherein said grease filtration system comprises:

a housing, an exhaust gas inlet for supplying exhaust gas to said housing, an exhaust gas outlet for expelling exhaust gas from said housing, at least one vertically-extending housing side wall extending between said exhaust gas inlet and said exhaust gas outlet, at least one first filter comprising metal filtration media and positioned within said housing such that an outer perimeter of said at least one first filter extends along and is proximate to an outer surface of said at least one vertically-extending housing side wall, and at least one second filter comprising non-woven non-metallic material and positioned proximate said exhaust gas outlet such that exhaust gas passing through said housing passes through said at least one first filter prior to said at least one second filter;

wherein said at least one first filter is positioned within said housing so that any grease accumulating on said at least one first filter flows along said at least one first filter toward and down said at least one vertically-extending housing side wall.

* * * * *